US005756915A

United States Patent [19]

Matsuda

[11] Patent Number: 5,756,915

[45] Date of Patent: May 26, 1998

[54] ELECTRONIC MUSICAL INSTRUMENT HAVING A SEARCH FUNCTION AND A REPLACE FUNCTION

[75] Inventor: Tatsuya Matsuda, Hamamatsu, Japan

[73] Assignee: Kabushiki Kaisha Kawai Gakki Seisakusho, Shizuoka-ken, Japan

[21] Appl. No.: 643,988

[22] Filed: May 7, 1996

Related U.S. Application Data

[63] Continuation of Ser. No. 130,786, Oct. 4, 1993, abandoned.

[30] Foreign Application Priority Data

Oct. 19, 1992 [JP] Japan ..... 4-304498
Oct. 23, 1992 [JP] Japan ..... 4-307835

[51] Int. Cl.[6] ..... G10H 1/36; G10H 7/00

[52] U.S. Cl. ..... 84/602; 84/609; 84/615; 84/647

[58] Field of Search ..... 84/600–604, 609–614, 84/615, 645, 647, 649

[56] References Cited

U.S. PATENT DOCUMENTS 4,526,078 7/1985 Chadaba ..... 84/1.03
4,957,552 9/1990 Iwase ..... 254/622
5,046,004 9/1991 Tsumura et al. ..... 364/419
5,225,618 7/1993 Wadhams ..... 84/602
5,262,580 11/1993 Tanaka et al. ..... 84/602
5,315,911 5/1994 Ochi ..... 84/477

*Primary Examiner*—Vit W. Miska

[57] ABSTRACT

A music performance information searching apparatus and a music performance information replacing apparatus. The music performance information searching apparatus includes a ROM or RAM for storing music performance data, a control panel or a keyboard for inputting search data to be searched, and a display unit or a sound source for outputting information of any searched part of the music performance data. The apparatus searches the music performance data stored in the ROM or RAM for a part of the music performance data which corresponds to the input search data, and outputs that searched part to the display unit or sound source. The music performance information replacing apparatus includes a ROM or RAM for storing music performance data, and a control panel or a keyboard for inputting search data to be searched and replacement data. This apparatus searches the music performance data stored in the ROM or RAM for a part of the music performance data which corresponds to the search data, and replaces that searched part with the replacement data entered from the control panel or the keyboard.

23 Claims, 9 Drawing Sheets

Fig. 4A

WHEN SEARCHING WITH TONE NAME

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| A | | 1 | | : | 2 | | : | 3 | | : | 4 | | | |
| B | | C | 1 | : | D | 3 | : | F | 2 | : | | | | |
| | | TONE NAME | | | TONE NAME | | | TONE NAME | | | | | | |

Fig. 4B

WHEN SEARCHING WITH VELOCITY

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| A | | 1 | | | : | 2 | | | : | 3 | | | | |
| B | | 0 | 6 | 4 | : | 0 | 6 | 4 | : | 0 | 6 | 4 | | |
| | | VELOCITY | | | | VELOCITY | | | | VELOCITY | | | | |

Fig. 4C

WHEN SEARCHING WITH BEAT

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| A | | 1 | | : | 2 | | : | 3 | | : | 4 | | | |
| B | | B | 1 | : | B | 2 | : | B | 3 | : | | | | |
| | | BEAT | | | BEAT | | | BEAT | | | | | | |

Fig. 5

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| A | B | A | R | | : | B | E | A | T | : | S | T | E | P |
| B | 0 | 6 | | | : | 0 | 3 | | | : | 3 | 7 | | |

Fig. 8

REPLACEMENT DATA SELECTING SCREEN

| | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| A | | D | A | T | A | — | S | E | L | E | C | T | | |
| B | | D | A | T | A | R | P | | | | | | | |

SC/RP

CURSOR

ELECTRONIC MUSICAL INSTRUMENT HAVING A SEARCH FUNCTION AND A REPLACE FUNCTION

This application is a continuation of application Ser. No. 08/130,786, filed on Oct. 4, 1993, now abandoned.

BACKGROUND OF THE INVENTION

The present invention relates to a music performance data searching apparatus which searches music performance data, prepared in advance, for a desired part of the music performance data, and a music performance data replacing apparatus which searches music performance data, prepared in advance, for a desired part of the music performance data and replaces the searched data with replacement data.

DESCRIPTION OF THE RELATED ART

Recently, electronic musical instruments, such as an electronic piano, an electronic organ and a synthesizer, have been developed and become popular. Those electronic musical instrument are designed such that as music performance data produced by the manipulation of, for example, a keyboard or a control panel, is supplied to a sound source provided in each electronic musical instrument, a musical tone according to this music performance data is generated.

A music performance information recording/reproducing apparatus, called a sequencer, has been developed and put into practice, which supports the function of such an electronic musical instrument to improve the value of this instrument in use. The sequencer has storage means for storing music performance data. The sequencer serves as a music performance information recording apparatus which stores music performance data generated by the manipulation of a keyboard, a control panel or the like, and also serves as a music performance information reproducing apparatus which reads out the music performance data stored in the storage area and supplies it to a sound source or the like. The sequencer may be an independent apparatus from an electronic musical instrument, or may be incorporated in an electronic musical instrument.

The sequencer is used not only as an apparatus for recording and reproducing music performance data, but also often used as an apparatus for preparing desired music performance data. To use the sequencer for preparation of music performance data, the following three processes are executed.

(a) inputting music performance data (b) editing the input music performance data (c) confirming the edited music performance data The desired music performance data will be completed by repeating processes (a) to (c).

Conventionally, there are two known methods of executing the process (a) to input music performance data: the real time input method and the step input method. In the real time input method, a user actually manipulates a keyboard connected to the sequencer, and data which is generated in accordance with the manipulation is stored as music performance information data in the storage means in the sequencer. The real time input method is very popular as this method allows a player to input music performance data into the sequencer by a simple operation of playing the keyboard. In the step input method, the player operates predetermined switches on the control panel provided on the sequencer to input notes as numeral data one by one and the data is sequentially stored in the storage area in the sequencer. As the step input method permits notes to be accurately input, professional music players prefer this method.

The aforementioned process (b) for editing music performance data is performed as follows. The player operates some switches on the control panel of the sequencer or the like to search the music performance data stored in the storage area in the sequencer for a part of the music performance data that is to be altered. This part of the music performance data is overwritten with new music performance data using the above-described inputting method (the real time input method or step input method).

The process (c) of confirming music performance data is executed as follows. The player operates some switches on the control panel of the sequencer or the like to search the music performance data stored in the storage area in the sequencer for a part of the music performance data which is to be confirmed. Then, a song position pointer indicating the current bar or beat, for example, is moved to that part of the music performance data. The music performance data is sequentially read out from the part of the music performance data that is indicated by the song position pointer, and this read-out music performance data is supplied to the sound source piece by piece to generate the associated sounds or is supplied to a display area of the sequencer to be displayed.

Editing and confirmation of music performance data are executed in the above-described manner. In the editing of the music performance data, however, whether the real time input method or the step input method is used, the player should operate the switches on the control panel of the sequencer to search the music performance data for a part of the music performance data which is to be corrected. Likewise, in the confirmation of music performance data, the player should operate the switches on the control panel of the sequencer to search the music performance data for a part of the music performance data which is to be confirmed. Accordingly, the player should grasp and manage the structure of music performance data himself or herself.

The operation for searching for a part of the music performance data which is to be corrected or confirmed is therefore tiresome. Recently, the amount of music performance data tends to becomes vast to provide elaborate music expressions. Naturally, this kind of operation becomes more tedious. It is therefore very difficult for the player to grasp and manage the structure of music performance data himself or herself. In addition, in editing the music performance data, when a part in the music performance data which is to be corrected is found, the player should input new data from the found part of the music performance data by operating the switches on the control panel or the keyboard.

In general, the same data, such as timbre change information or note information indicating a specific phrase, frequently appears in the music performance data. To prepare the music performance data having such a structure, normally, timbre change information or music performance data indicating a specific phrase is previously stored as a data block in the storage area. This data block is copied as needed to prepare desired music performance data.

There often is a case where there are plural pieces of music performance data which are alike but slightly different from one another. To prepare the music performance data having such a structure, first, a block of a portion of music performance data is copied on a plurality of locations in the music performance data at the time of data preparation. Next, the player should operate the switches on the control panel to search the copied blocks of the music performance data for the desired part of music performance data. The player then alters the searched block of the music performance data by operating the switches on the control panel or the like.

There may be a case where parts of music performance data which are alike but slightly different from one another are changed to the same part of music performance data. In this case too, the player should operate the switches on the control panel or the like to search the parts of the music performance data for the desired part of music performance data and the searched part of the music performance data is changed to the desired part of the music performance data.

In the editing of music performance data, as described above, the operation of searching the parts of the music performance data and changing the searched part to the desired part of the music performance data should be executed frequently. According to the conventional sequencer, however, the operation of searching the parts of the music performance data which are to be corrected and the operation of changing the searched part of the music performance data to the desired part of the music performance data are tedious and take time.

OBJECTS AND SUMMARY OF THE INVENTION

It is therefore a first object of the present invention to provide a music performance data searching apparatus which allows a player to easily search music performance data for a part of the music performance data which is to be edited or confirmed.

It is a second object of the present invention to provide a music performance data replacing apparatus which allows a player to search music performance data for a part of the music performance data which is to be edited and to replace the part of the music performance data with a desired part of music performance data by a simple operation.

To achieve the first object, according to the first aspect of the present invention, there is provided a music performance data searching apparatus comprising storage means for storing music performance data; inputting means for inputting search data to be searched; searching means for searching the music performance data stored in the storage means for a part of the music performance data which corresponds to the search data inputted from the inputting means; and outputting means for outputting information of the part of the music performance data corresponding to the search data.

According to the music performance information searching apparatus of the first aspect of the present invention, as music performance data having a predetermined phrase is entered as search data to be searched, a part of the music performance data which corresponds to the predetermined phrase is detected from the music performance data stored in the storage means, and information associated with the part of the music performance data, e.g., information such as the bar and beat of the music performance data or the part of the music performance data itself can be output. Through a simple operation of inputting the search data, the player can know that the part of the music performance data corresponding to the search data exists in the music performance data and can know the bar and beat where the phrase corresponding to the search data is present, or the like. Unlike in the prior art, therefore, the player can easily edit and confirm the searched part of the music performance data without grasping or managing the structure of the music performance data.

According to a preferable modification of the music performance information searching apparatus according to the first aspect of the present invention, instructing means for instructing continuation of a searching operation is further provided. This design can permit the player to know plural parts of the music performance data associated with the same search data. Therefore, the player can easily and conveniently edit and confirm the desired part of the music performance data.

According to a preferable embodiment of the music performance data searching apparatus of the first aspect and the preferable modification thereof, the searching means may be designed in such a way as to search the music performance data stored in the storage means for a part of the music performance data which is the same as the search data input from the inputting means. Alternatively, the searching means may be designed in such a way as to search the music performance data stored in the storage means for a part of the music performance data which is the same as the search data inputted from the input means and a part of the music performance data which has a predetermined relation with the search data.

According to a preferable embodiment of the music performance data searching apparatus of the first aspect and the preferable modification thereof, the inputting means may be a control panel. This design permits the player to input the search data in the same way as done in the step input method, thus ensuring the accurate and elaborate inputting of the search data. Alternatively, the inputting means may be a keyboard. This design permits the player to input the search data in the same way as done in the real time input method, thus facilitating the inputting operation.

According to a preferable embodiment of the music performance data searching apparatus of the first aspect and the preferable modification thereof, the outputting means may be a display unit for displaying information of the part of the music performance data searched by the searching means. This design allows the display unit to display information which may indicate the bar, beat, etc. of the searched part of the music performance data, thus facilitating the alteration of the searched part of the music performance data. Alternatively, the outputting means may be tone generating means for generating a musical tone based on information of the part of the music performance data searched by the searching means. The tone generating means may include a sound source and a loudspeaker. As the tone generating means generates a musical tone based on the searched part of the music performance data, the player can easily confirm with his or her ears that the desired part of the music performance data has been searched.

To achieve the first object, according to the second aspect of the present invention, there is provided a music performance data searching apparatus comprising storage means for storing plural pieces of music performance data corresponding to plural pieces of music; selecting means for selecting the music performance data which corresponds to a given piece of music from among the plural pieces of the music performance data stored in the storage means; inputting means for inputting search data to be searched; searching means for searching the music performance data selected by the selecting means for a part of the music performance data which corresponds to the search data inputted from the inputting means; and outputting means for outputting information of the part of the music performance data corresponding to the search data.

In the music performance information searching apparatus according to the second aspect of the present invention, with the storage means storing plural pieces of the music performance data corresponding to plural pieces of music, when the music performance data corresponding to a desired piece of music is selected by the selecting means and search data to be searched is input, the selected music performance data is subjected to the same operation as done in the music performance information searching apparatus of the first aspect of the present invention. In a system with the use efficiency of the storage means improved by storing plural pieces of the music performance data corresponding to plural pieces of music in this storage means, the music performance data corresponding to the desired piece of music can be searched for. This music performance data searching apparatus can therefore facilitate the management and handling of the prepared music performance data as well as has the same advantages as the music performance information searching apparatus of the first aspect of the present invention.

According to a preferable modification of the music performance data searching apparatus according to the second aspect of the present invention, instructing means for instructing continuation of a searching operation is further provided.

According to a preferable embodiment of the music performance data searching apparatus of the second aspect and the preferable modification thereof, the searching means may be designed in such a way as to search the music performance data selected by the selecting means for a part of the music performance data which is the same as the search data inputted from the inputting means. Alternatively, the searching means may be designed in such a way as to search the music performance data selected by the selecting means for a part of the music performance data which is the same as the search data inputted from the input means and a part of the music performance data which has a predetermined relation with the search data.

According to a preferable embodiment of the music performance data searching apparatus of the second aspect and the preferable modification thereof, the inputting means may be a control panel. Alternatively, the inputting means may be a keyboard.

According to a preferable embodiment of the music performance data searching apparatus of the second aspect and the preferable modification thereof, the outputting means may be a display unit for displaying information of the part of the music performance data searched by the searching means. Alternatively, the outputting means may be tone generating means for generating a musical tone based on information of the part of the music performance data searched by the searching means.

To achieve the second object according to the third aspect of the present invention, there is provided a music performance data replacing apparatus comprising storage means for storing music performance data; inputting means for inputting search data to be searched and replacement data to be replaced; searching means for searching the music performance data stored in the storage means for a part of the music performance data which corresponds to the search data input from the inputting means; and replacing means for replacing the part of the music performance data corresponding to the search data searched by the searching means with the replacement data inputted from the input means.

According to the music performance data replacing apparatus of the third aspect of the present invention, music performance data to be searched, e.g., music performance data having a predetermined phrase is entered as search data and music performance data to be replaced is entered as replacement data. Accordingly, the part of the music performance data which corresponds to the search data can be replaced with the replacement data. Through a simple operation of inputting the search data and replacement data, the part of the music performance data which has a, for example, a specific phrase with the music performance data which has another and desired phrase. Unlike in the prior art, therefore, the player can easily perform data edition or the like without grasping or managing the structure of the music performance data.

According to a preferable modification of the music performance data replacing apparatus according to the third aspect of the present invention, instructing means for instructing continuation of a search and replace operation is further provided. This design can ensure a continuous search and replace of desired plural parts of the music performance data. Therefore, the player can easily search and replace the desired parts of the music performance data.

According to a preferable embodiment of the music performance data replacing apparatus of the third aspect and the preferable modification thereof, the searching means may be designed in such a way as to search the music performance data stored in the storage means for a part of the music performance data which is the same as the search data inputted from the inputting means. Alternatively, the searching means may be designed in such a way as to search the music performance data stored in the storage means for a part of the music performance data which is the same as the search data inputted from the inputting means and a part of the music performance data which has a predetermined relation with the search data.

According to a preferable embodiment of the music performance data replacing apparatus of the third aspect and the preferable modification thereof, the inputting means may be a control panel. Alternatively, the inputting means may be a keyboard.

According to a preferable embodiment of the music performance data replacing apparatus of the third aspect and the preferable modification thereof, outputting means may be further provided which outputs information of the part of the music performance data corresponding to the search data searched by the searching means. This design can permit the player to easily confirm the part of the music performance data which has become the target of the search and replace operation. In this case, the outputting means may be a display unit for displaying information of the part of the music performance data searched by the searching means. Alternatively, the outputting means may be tone generating means for generating a musical tone based on information of the part of the music performance data searched by the searching means.

According to another preferable modification of the music performance data replacing apparatus according to the third aspect of the present invention, plural pieces of music performance data corresponding to plural pieces of music are stored in the storage means; selecting means is further provided for selecting the music performance data which corresponds to a given piece of music from among the plural pieces of the music performance data stored in the storage means; and the searching means searches the music performance data selected by the selecting means for a part of the music performance data which corresponds to the search data input from the inputting means.

According to this structure, with the storage means storing plural pieces of the music performance data corresponding to plural pieces of music, when the music performance data corresponding to a desired piece of music is selected by the selecting means and search data is input, the selected music performance data is subjected to the same operation as done in the music performance information replacing apparatus of the third aspect. In a system with the use efficiency of the storage means improved by storing plural pieces of the music performance data corresponding to plural pieces of music in the storage means, it is possible to search and replace the music performance data corresponding to the desired piece of music. This music performance data replacing apparatus can therefore facilitate the management and handling of the prepared music performance data and also has has the same advantages as the music performance data replacing apparatus of the third aspect.

To achieve the second object, according to the fourth aspect of the present invention, there is provided a music performance data replacing apparatus comprises storage means for storing music performance data; inputting means for inputting search data to be searched; searching means for searching the music performance data stored in the storage means for a part of the music performance data which has a predetermined relation with the search data input from the inputting means; and replacing means for replacing the part of the music performance data corresponding to the search data searched by the searching means with the search data input from the inputting means.

According to the music performance information replacing apparatus of the fourth aspect, with the music performance data stored in the storage means, as music performance data having, for example, a predetermined phrase is entered as search data, a part of the music performance data which has a value lying within a predetermined margin around the value of the search data, i.e., a part of the music performance data which is close to the search data, can be searched out in the music performance data and can be replaced with the search data. Unlike in the prior art, therefore, the player can replace a part of the music performance data which has a phrase similar to a predetermined phrase with the music performance data (the search data) that has the predetermined phrase without grasping or managing the structure of the music performance data, thus facilitating data edition or the like.

According to a preferable modification of the music performance data replacing apparatus according to the fourth aspect, instructing means for instructing continuation of a search and replace operation is further provided.

According to a preferable embodiment of the music performance data replacing apparatus of the fourth aspect and the preferable modification thereof, the inputting means may be a control panel. Alternatively, the inputting means may be a keyboard.

According to another preferable modification of the music performance data replacing apparatus of the fourth aspect, outputting means may be further provided which outputs information of the part of the music performance data corresponding to the search data searched by the searching means. In this case, the outputting means may be a display unit for displaying information of the part of the music performance data searched by the searching means. Alternatively, the outputting means may be tone generating means for generating a musical tone based on information of the part of the music performance data searched by the searching means.

According to a further preferable modification of the music performance data replacing apparatus according to the fourth aspect, plural pieces of music performance data corresponding to plural pieces of music are stored in the storage means; selecting means is further provided for selecting the music performance data which corresponds to a given piece of the music from among the plural pieces of the music performance data stored in the storage means; and the searching means searches the music performance data selected by the selecting means for a part of the music performance data which corresponds to the search data input from the inputting means.

These and other objects of the present invention will become more readily apparent from the detailed description given hereafter. However, it should be understood that detailed description of the specific examples, while indicating preferred embodiments in the invention are given by way of illustration only, since various changes and modifications within the spirit and scope of the invention will become apparent to those skilled in the art from the detailed description.

BRIEF DESCRIPTION OF THE DRAWINGS

FIGS. 4A through 4C are diagrams for explaining an operation for inputting search data or replacement data in the music performance information searching apparatus or music performance data replacing apparatus according to one embodiment of the present invention;

FIG. 5 is a diagram showing an output example of the search result in the music performance information searching apparatus or music performance data replacing apparatus of the present invention;

FIG. 8 is a diagram for explaining an operation for selecting replacement data in the music performance data replacing apparatus of one embodiment of the present invention.

Further scope of applicability of the present invention will become apparent from the detailed description given hereafter. However, it should be understood that the detailed description and specific examples, while indicating preferred embodiments of the invention are given by way of illustration only, since various changes and modifications within the spirit and scope of the invention will become apparent to those skilled in the art from this detailed description.

DETAILED DESCRIPTION OF THE PREFERRED EMBODIMENT

A music performance data searching apparatus and a music performance data replacing apparatus according to respective embodiments of the present invention will now be described in detail referring to the accompanying drawings. The following description will be centered on the structure and operation, which accomplish a search process of searching music performance data stored in a storage area (hereinafter simply called "search process") and a search and replace process (hereinafter simply called "replacing process").

First Embodiment

Figure 1:
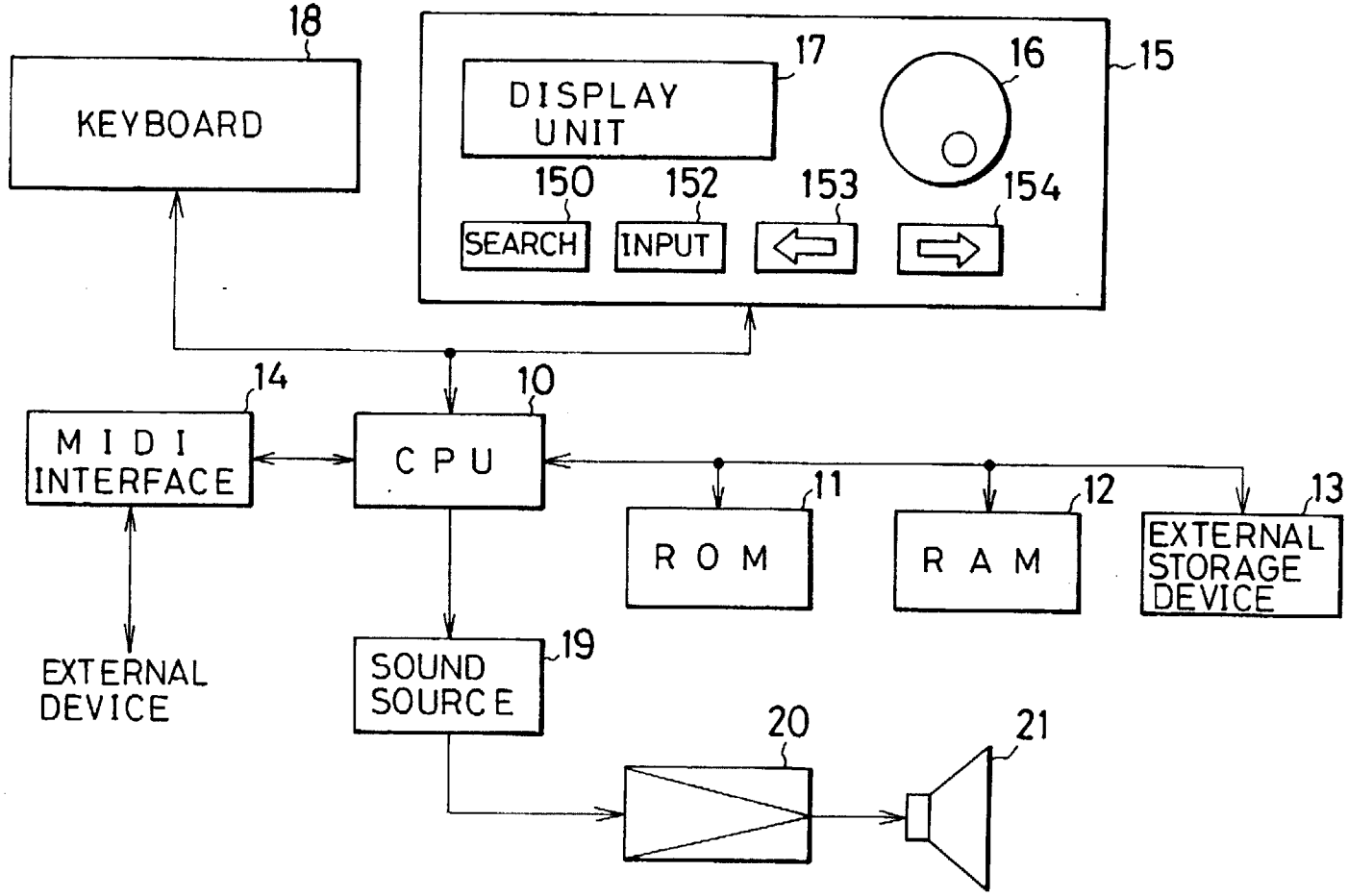
FIG. 1 is a block diagram illustrating the schematic structure of a music performance data searching apparatus according to one embodiment of the present invention as applied to an electronic musical instrument having a sequencer function.

The first embodiment relates to a music performance data searching apparatus. FIG. 1 presents a block diagram showing the schematic structure of the music performance data searching apparatus according to the first embodiment. This music performance data searching apparatus is incorporated in an electronic musical instrument having a sequencer function.

The music performance data searching apparatus includes a CPU 10. This CPU 10 performs general control of the electronic musical instrument, which contains the music performance data searching apparatus of the present invention, in accordance with a control program stored in a read only memory (hereinafter called "ROM") 11. The search process which characterizes the present invention is accomplished by the CPU 10. The detailed description of the search process will be given later. Connected to this CPU 10 are the ROM 11, a random access memory (hereinafter called "RAM") 12, an external storage device 13, a MIDI interface 14, a control panel 15, a keyboard 18 and a sound source 19.

Stored in the ROM 11 are various pieces of fixed data which are used by the CPU 10 in various processes in addition to the aforementioned control program for controlling the CPU 10. The stored contents of the ROM 11 are read out by the CPU 10.

Storage for temporarily storing music performance data comprises the RAM 12. The RAM 12 also temporarily stores various pieces data necessary in running the control program. Individual areas, such as a data buffer, registers, and flags, are defined in the RAM 12. The RAM 12 temporarily stores music performance data read-out from the external storage device 13, music performance data which is supplied via the MIDI interface 14 from an external device, music performance data supplied from the keyboard 18, or music performance data which is entered using the control panel 15. The music performance data stored in the RAM 12 is the search target in the search process. Music performance data which has undergone the search process is stored in the external storage device 13, or is transferred to an external device, such as a personal computer, which is connected via the MIDI interface 14 to the CPU 10, and is stored there. The RAM 12 can store plural pieces of music performance data corresponding to plural pieces of music as needed. In this case, a specific number called "song number" is affixed to the music performance data corresponding to each piece of music. The music performance data which is the search target in the search process is specified by this song number.

The external storage device 13 stores various pieces of the music performance data. This external storage device 13 may be a floppy disk, a hard disk, a rewritable optical disk or a magnetic tape. The provision of such an external storage device allows this electronic musical instrument to serve as a sequencer which handles a vast amount of the music performance data.

The MIDI interface 14 controls exchange of MIDI data between the electronic musical instrument and an external device. An example of the external device may be a personal computer, mentioned above, which sends and receives the MIDI data.

The control panel 15 is provided with switches 150 and 152 to 154, which are used to provide various operation instructions to the electronic musical instrument, a dial 16 for inputting numeral data to be set, and a display unit 17 which is used to display given information. Only those portions which are necessary to permit the electronic musical instrument to function as a music performance information searching apparatus are illustrated in the control panel 15 in FIG. 1. The switches on the control panel 15 include the search switch 150, input switch 152, and cursor moving switches 153 and 154. The search switch 150 is for starting the search process. The input switch 152 is a switch which gives an instruction to send numeral data, displayed on the display unit 17, to the CPU 10. The cursor moving switches 153 and 154 are part of the inputting means and selecting means and also instructing means. Those cursor moving switches 153 and 154 can be used to instruct the continuation of the search process as well as to move a cursor displayed on the display unit 17. The ON or OFF status of each of those switches is detected by a panel scan circuit (not shown), and is sent as panel switch information to the CPU 10. The CPU 10 refers to the panel switch information to trigger various processes.

The dial 16 is part of the inputting means and the selecting means in one embodiment of the present invention. The dial 16 may be a rotary encoder. A numeral entered through the dial 16 is supplied to the CPU 10 and is displayed on the display unit 17. Turning the dial 16 rightward increases the numeral and turning the dial 16 leftward decreases the numeral.

The display unit 17 can also constitute part of the inputting means, the selecting means and outputting means. The display unit 17 may be a character display unit including an LCD (Liquid Crystal Display) further including 14 columns by 2 rows. Various types of messages may be displayed on the display unit 17 to be used as guidance at the time of inputting search data to be searched (hereinafter simply referred to as "search data"), for example. The display unit 17 may be used as a register at the time of inputting a numeral. The display contents of the display unit 17 vary depending on data that is sent from the CPU 10. The display unit 17 is not limited to the 14 by 2 LCD, but may be an LCD of arbitrary size, or a display device of an arbitrary type. Large search data can be designated by increasing the display capacity of the display unit 17 as will be described later.

Figure 3:
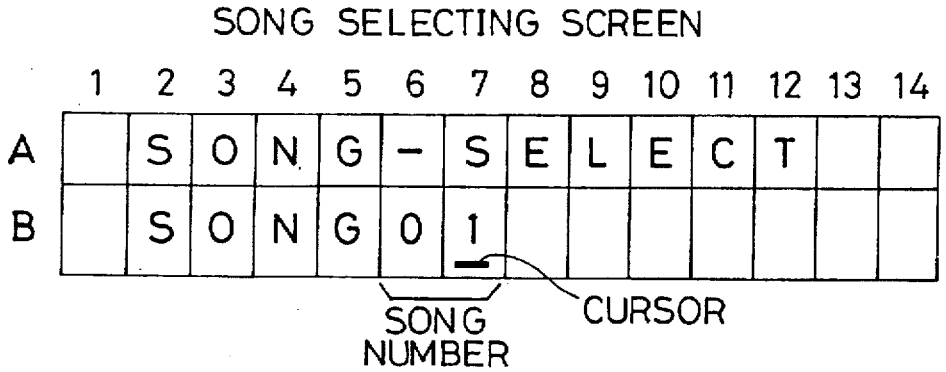
FIG. 3 is a diagram for explaining an input operation for song selection in a music performance data searching apparatus or music performance data replacing apparatus according to one embodiment of the present invention.

At the time one piece of music which is a search target is selected from plural pieces of music as needed before the search process, a song selection screen as shown in, for example, FIG. 3 will be used. An input field is formed in the locations 6B and 7B of this song selection screen. A player alters the contents of the input field by manipulating the cursor moving switch 153 or 154 and the dial 16 while viewing the display contents of the display unit 17. The data placed in this input field is supplied as a song number to the CPU 10.

The keyboard 18 is used to instruct the interval of a musical tone in a mode for normal music performance (hereinafter called "normal performance mode"). The keyboard 18 can be used as the inputting means to enter the search data in a mode for executing the search process (hereinafter called "search mode"). (The details of the search process will be given later.)

A signal indicating the ON/OFF of each key from the keyboard 18 is stored in the RAM 12 as key depression information including of a sequence of bits associated with each key, under the control of the CPU 10. This key depression information is transformed to, for example, music performance data of a MIDI format as needed before being stored in the RAM 12.

The sound source 19 generates a tone signal in accordance with tone data from the CPU 10, which indicates an interval, a timbre, a volume or the like. The tone signal generated from the sound source 19 is supplied to an amplifier 20.

The amplifier 20 is of a know type which amplifies the input tone signal with a predetermined amplification factor before outputting. The tone signal that has undergone a predetermined amplification in the amplifier 20 is supplied to a loudspeaker 21.

The loudspeaker 21 is of a known type which converts the tone signal as an electric signal into an acoustic signal. Through this loudspeaker 21, a musical tone associated with the depression of a key on the keyboard 18 is sounded in normal performance mode or a musical tone associated with music performance data read-out from the RAM 12 is sounded in automatic performance mode.

The operation of the music performance data searching apparatus with the above-described structure according to the present invention will now be described in detail referring to the flowchart shown in FIG. 2. Only the portion which is directly concerned with the present invention is illustrated in this flowchart and will be explained below.

In performing the search process in the music performance data searching apparatus, the following operation will be carried out. First, with the song selection screen in FIG. 3 displayed, the player uses the cursor moving switch 153 or 154 to move the cursor to the location 7B, and then operates the dial 16 to register the song number. At this time, turning the dial 16 rightward will increase the numeral of the song number displayed and turning the dial 16 leftward decreases it. Then, the player depresses the input switch 152, sending the registered song number to the CPU 10.

After that, the display unit 17 shows a screen to request the inputting of search data, as shown in, for example, any of FIGS. 4A to 4C. Then, the player registers the search data using the cursor moving switch 153 or 154 and the dial 16. Next, the player depresses the input switch 152, causing the registered search data to be sent to the CPU 10. When the above operation is complete, the search process will start.

Figure 2:
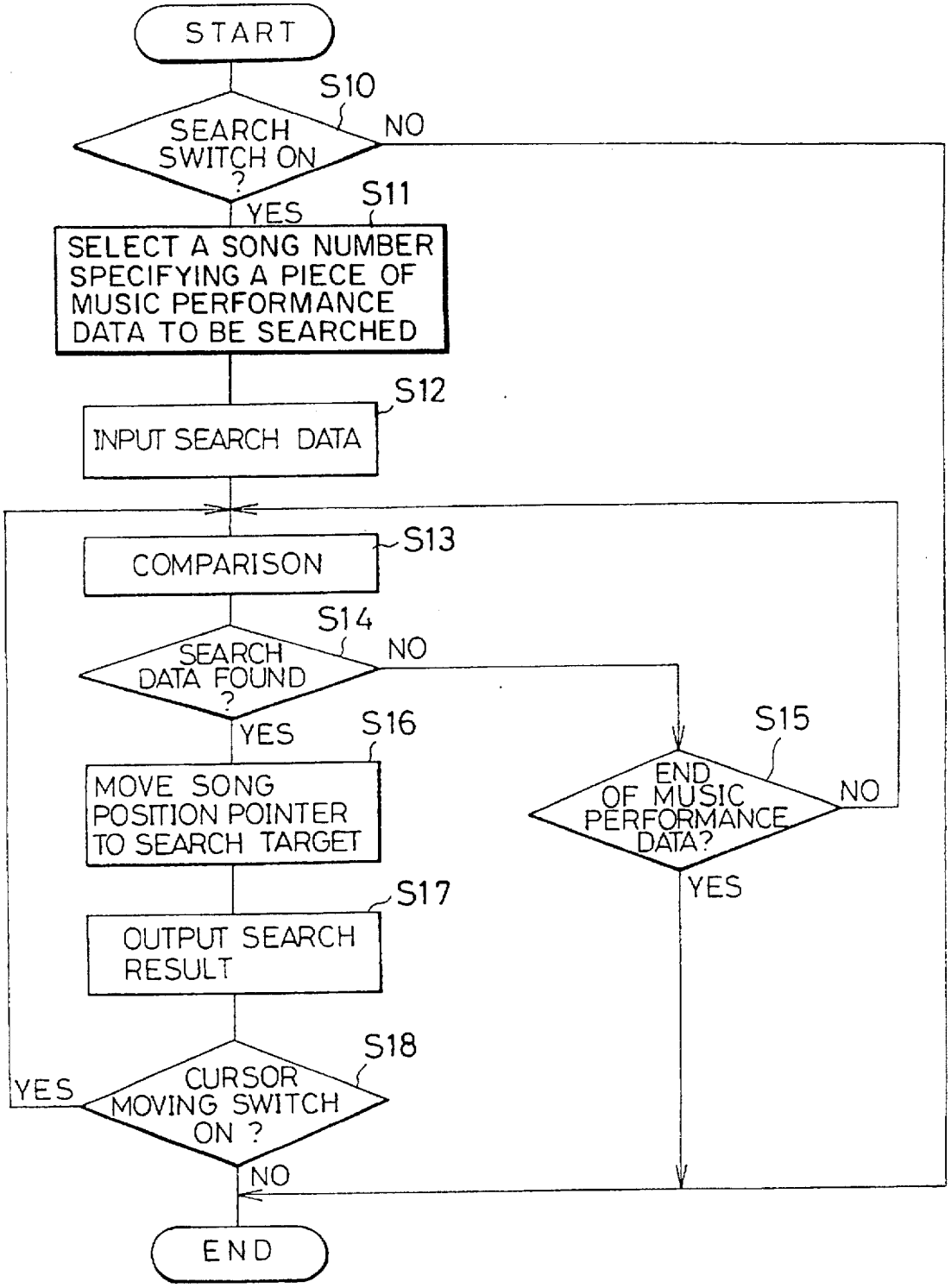
FIG. 2 is a flowchart illustrating the operation of a music performance data searching apparatus according to an embodiment of the present invention.

The flowchart in FIG. 2 illustrates the search process routine, which is called from a main routine (not shown) at every given period.

When the search process starts, it is checked first whether or not the search switch 150 has been depressed (step S10). This check is done by checking the panel switch information that indicates the ON or OFF status of the switch which is detected by the panel scan circuit (not shown).

If it is determined that the search switch 150 is not switched on, the search process will be terminated without executing any process. When it is determined that the search switch 150 is switched on, on the other hand, music performance data to be searched will be selected if the selecting means is incorporated in the music performance data searching apparatus (step S11).

When it is determined that the search switch 150 is on, the display of the display unit 17 is changed to the song selection screen as shown in, for example, FIG. 3, and a message "SONG-SELECT" will be displayed on the display unit 17. The player uses the cursor moving switch 153 or 154 to move the cursor to the location 7B, and then operates the dial 16 to register the song number. Then, the player depresses the input switch 152, sending the registered song number to the CPU 10. In the subsequent search process, one piece of the music performance data associated with the song number is selected. The selected piece of the music performance data is the search target. If no selecting means is incorporated in the music performance data searching apparatus and only one piece of the music performance data is stored in the storage means, this step will be omitted.

Then, search data is input (step S12). When music performance data to be searched for is established in the aforementioned step S11, the display of the display unit 17 is changed to the search data inputting screen as shown in, for example, FIG. 4A. As a message is displayed in the row A of the display unit 17, the player uses the cursor moving switch 153 or 154 to move the cursor to the location 3B, and then operates the dial 16 to register the tone name. FIG. 4A shows an example where the player register a tone name "C1" as the first musical tone of the search data. Likewise, the player uses the cursor moving switch 153 or 154 to move the cursor to the location 6B, and then operates the dial 16 to register the second tone name ("D3" in the diagram). Further, the player uses the cursor moving switch 153 or 154 to move the cursor to the location 9B, and then operates the dial 16 to register the third tone name ("F2" in the diagram). Then, the player depresses the input switch 152, sending the registered sequence of tone names "C1, D3 and F2" to the CPU 10. In the subsequent search process, the search process is performed using this sequence of tone names as search data. If a sequence of tone names is used in this manner, it is possible to search the music performance data for a part of the music performance data which has the same sequence of tone names or a certain phrase as the search data.

Although a sequence of tone names of three tones is to be entered as search data in the above example, the number of tone names to be entered is arbitrary within the registerable range in the display unit 17. The sequence of tone names which becomes search data may be entered in more than one action. With this design taken, a longer sequence of tone names can become search data.

Although tone names are given as search data in the above example; velocity values may also be used as search data. For instance, velocity values are registered in the display unit 17 as shown in FIG. 4B in the same manner as done in the above case of inputting tone names. Then, the player depresses the input switch 152 to send the registered sequence of velocity values as search data to the CPU 10. With this structure, it is possible to search the music performance data for a part of the music performance data which has the same sequence of velocity values or a change in strength of the same tone as the search data. In this case too, the length of the sequence of velocity values, as search data may be variable as in the above-described case of tone names.

Beat values may also be used as search data. For instance, beat values are registered in the display unit 17 as shown in FIG. 4C in the same manner as done in the above case of inputting tone names. Then, the player depresses the input switch 152 to send the registered sequence of beat values as search data to the CPU 10. With this structure, it is possible to search the music performance data for a part of the music performance data which has the same sequence of beat values or a change in beat of the same tone as the search data. In this case too, the length of the sequence of beat values as search data may be variable as in the above-described case of tone names.

Further, the tone name, velocity or beat may be selectively used as search data. For instance, a switch for selecting the type of search data may be provided on the control panel 15, and predetermined guidance may be displayed on the display unit 17 in accordance with the type of the search data selected by this switch, thus allowing a predetermined piece of search data matching with the guidance to be entered.

Alternatively, a field for inputting the type of search data may be provided at a predetermined position of the display unit 17 so that search data associated with the aforementioned tone name, velocity or beat may be entered in accordance with the type of search data that is entered in this field. With this structure, it is possible to select the type of search data as needed, thus ensuring a music performance information searching apparatus which is easier to operate.

It is also possible to input all or combination of the tone name, velocity and beat as search data and conduct a search that satisfies the conditions. With this structure, desired music performance data can be searched for more precisely.

It is also possible to use other data than the tone name, velocity and beat as search data.

Although the search data is entered using the control panel 15 in the same way as the so-called step input, the search data may be entered in real time. In other words, when the keyboard 18 is operated with the inputting of search data requested in step S12, music performance data that is generated by this operation of the keyboard 18 can be used as search data. More specifically, a sequence of tone names, a sequence of velocity values and a sequence of beat values are extracted from the music performance data that has been generated by the manipulation of the keyboard 18, and are each used as search data. Alternatively, a sequence of tone names, a sequence of velocity values and a sequence of beat values are all used as search data. This method allows the search data to be entered easily.

When the inputting of the search data is completed in this manner, a comparison will be performed next (step S13). In this comparing process, the music performance data to be searched is read-out piece-by-piece from the RAM 12 to be compared with the aforementioned search data. In the comparing process, it is checked if the same data portion as the search data is present in the music performance data. That is, a portion of the music performance data having the same length as the search data is extracted from the beginning of the music performance data and is compared with the search data. Hereinafter, music performance data which is to be compared with the search data and has the same length as the search data will be called a sequence of search music performance data. The above operation is repeated while shifting the music performance data extracting position forward in order until there is no music performance data present.

Although the search data fully matches with a part of the music performance data in the above case, the comparison may be conducted on a sequence of search music performance data having a value within a predetermined range with respect to the value of the search data. For instance, with a tone name treated as search data, when the tone name "D3" is designated as search data, the comparison may be carried out with everything from the tone name "C3" to the tone name "E3" included in the tone name "D3." With regard to the velocity values and the beat values, the comparison may be likewise conducted within a predetermined range including the inputted value (search data). The value of the predetermined range for the value of the search data may be fixed or may be determined by inputting a value of the predetermined range using the control panel 15. With this structure, the comparison may be conducted not only on a sequence of search music performance data which has the same sequence of tone names, the same sequence of velocity values or the same sequence of beat values as the search data, but also a sequence of search music performance data which has the tone names, velocity values or beat values in a similar sequence to the search data, i.e., a sequence of tone names, a sequence of velocity values or a sequence of beat values which varies within a predetermined range. This method can overcome the otherwise possible drawback such that the entry of the accurate music performance data or accurate search data is not possible in the case of searching the music performance data that is prepared in the real time input or in the case of conducting a search using the search data that is entered in the real time input. This method is particularly effective in the case where the music performance data that is prepared in the real time input is to be searched using the velocity values as search data.

In the comparing process, the music performance data having a predetermined length (e.g., one bar) may be extracted and it may be checked whether or not search data appears in the music performance data having a predetermined length. For example, with tone names "C1, D3 and F2" being the search data, it is possible to check if "C1, D3 and F2" exist in the music performance data having a predetermined length (e.g., one bar). In other words, the comparing process may be designed in such a way that even if the music performance data having a predetermined length includes of "W, C1, X, D3, Y, Z and F2", the music performance data having the predetermined length is judged as matching with the search data. In this example, "W" is a tone name other than C1, "X" is a tone name other than D3, and "Y" and "Z" are tone names other than F2. With this structure, even if the music performance data that has been prepared in the real time input contains an extra tone (the tone name W, X, Y and Z in the previous example) due to an erroneous touch, a portion of the music performance data which corresponds to this extra tone would be excluded from the search target, thus making it possible to determine if a predetermined sequence of data (search data) is included in the music performance data having a predetermined length. It is to be noted that "music performance data having a predetermined length" is also included in the term "a sequence of search music performance data."

Through the comparison of the search data with the sequence of search music performance data done in the above manner, it is checked if a part of the music performance data corresponding to the search data is found, i.e., if a part of the music performance data which satisfies the set searching condition (that is the sequence of search music performance data (including the music performance data having a predetermined length) is fully matched with the search data or fallen within a predetermined range of the search data is found (step S14). When it is determined that the search data is not found in the music performance data, it is then checked if there is no more music performance data or if the comparison has been conducted until the end of the music performance data (step S15). When it is determined that the end of the music performance data has been reached, this comparing process will be terminated.

If it is determined that the comparison has not been conducted until the end of the music performance data, the flow returns to step S13. The position for extracting the music performance data is then advanced, and the next portion of the music performance data is extracted as the next sequence of search music performance data to be compared and is subjected to the same process as has been described above. The amount of increment of the extracting position may be changed in accordance with the search method. For instance, one piece of data in the music performance data, one bar of data or another predetermined data length may be taken as the amount of the increment.

When it is determined in step S14 in the loop of the steps S13, S14 and S15 that the sequence of search music performance data satisfies the search condition, the song position pointer is shifted to the head of the sequence of search music performance data (step S16). The song position pointer indicates which beat of which bar is currently executed. The sequence of search music performance data that meets the search condition is a part of the music performance data which corresponds to the search data.

Then, the search result will be outputted (step S17). In the outputting of the search result, information such as the bar (BAR), beat (BEAT) and step time (STEP) as shown in FIG. 5 can be displayed on the display unit 17 of the control panel 15. FIG. 5 shows that the part of the music performance data corresponding to the search data exists after the third beat in the sixth bar. The outputting of the search result may be accomplished by generating a musical tone based on the music performance data located after the searched position. That is, at least the portion of the music performance data following the song position pointer is read out and is supplied to the sound source 19 to generate a tone signal corresponding to the music performance data, and this tone signal is supplied through the amplifier 20 to the loudspeaker 21 to be sounded. As a result, the player can know that the desired part of the music performance data has been found out. The outputting of the search result may also be accomplished by simultaneously displaying the search result on the display unit 17 and generating a musical tone from the sound source 19 or the like. This structure can make the confirmation of the search result easier.

It is then checked if the cursor moving switch 153 or 154 has been depressed (step S18). During the execution of this search process, the cursor moving switches 153 and 154 can be used as the instructing means to instruct if the search should be continued. When it is determined that the cursor moving switch 153 or 154 has been depressed, the flow returns to step S13 and the above-described operation will be repeated. It is therefore possible to continuously perform the search process with respect to the same search data, allowing the positions of the parts of the music performance data to be easily found when the same part of the music performance data appears in the music performance data more than once. At this time, the cursor moving switch 153 is used to instruct the forward search, while the cursor moving switch 154 is used to instruct the backward search. Accordingly, the search is possible in any direction so that the music performance data searching apparatus has a better operability. If the cursor moving switches 153 and 154 are not given the ability of the instructing means, a single search process or a sequence of the search process from the beginning to the end of the music performance data with a predetermined interval for outputting the search result would be executed.

As described in details above, the present invention can provide a music performance data searching apparatus which permits the player to easily search for the part of the music performance data which is to be edited or confirmed.

Second Embodiment

Figure 6:
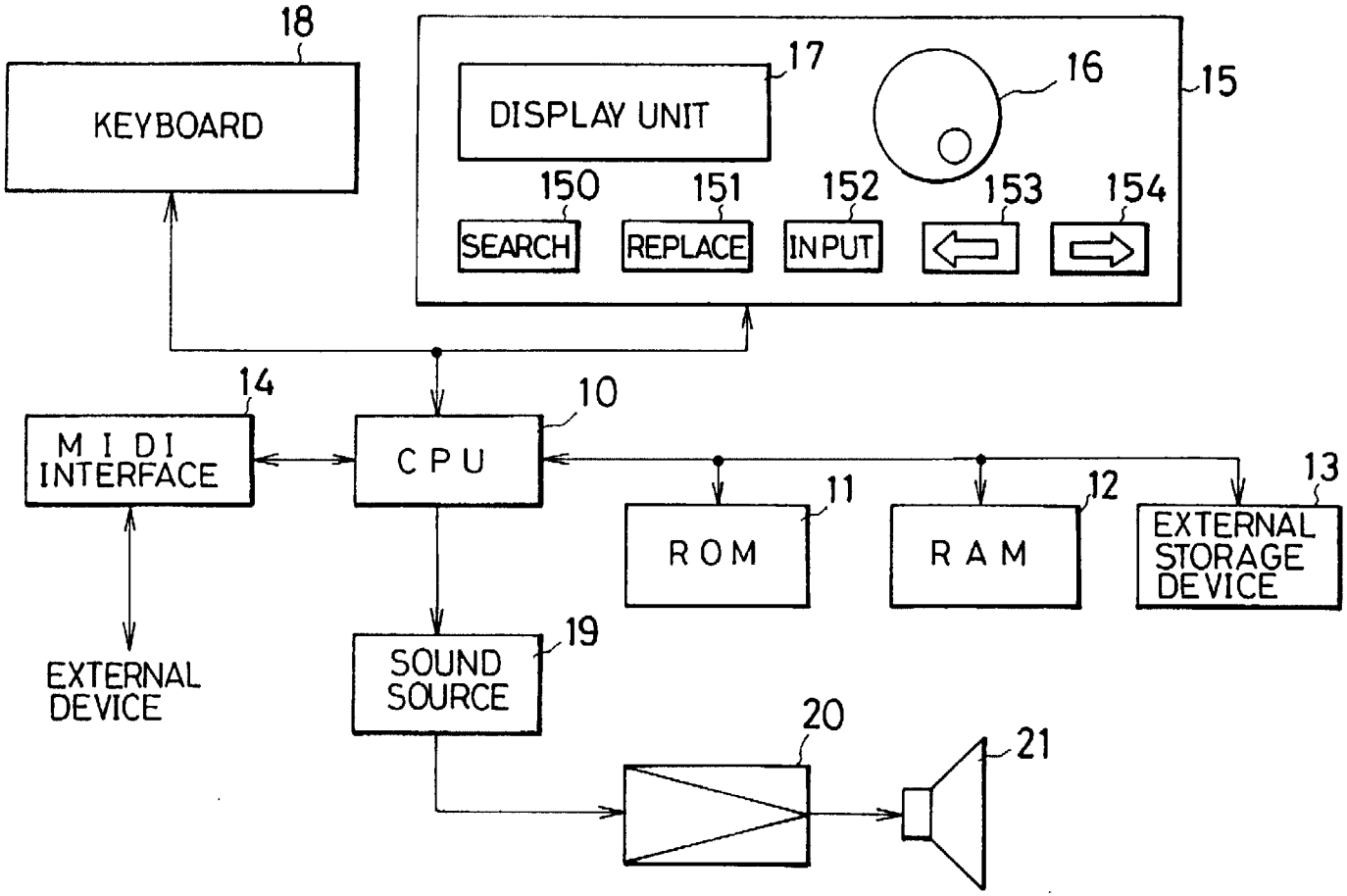
FIG. 6 is a block diagram illustrating the schematic structure of a music performance data replacing apparatus according to one embodiment of the present invention as applied to an electronic musical instrument having a sequencer function.

The second embodiment relates to a music performance data replacing apparatus. FIG. 6 presents a block diagram showing the schematic structure of a music performance data replacing apparatus according to the second embodiment. This music performance data replacing apparatus is incorporated in an electronic musical instrument having a sequencer function.

The music performance data replacing apparatus according to the second embodiment can have the same searching function of the above-described music performance data searching apparatus as needed, in addition to an original replacing function for searching music performance data for a part of the music performance data and replacing it with a predetermined piece of music performance data. Since the portion which performs the same searching function as the music performance information searching apparatus has already been explained above, only the portion which performs the replacing function as the music performance data replacing apparatus will be described below.

The structure of the music performance data replacing apparatus shown in FIG. 6 is substantially the same as the above-described structure of the music performance data searching apparatus shown in FIG. 1 with the difference in the additional provision of a replacing switch 151 on the control panel 15.

Therefore, the same reference numerals as used in FIG. 1 will be given to the corresponding or identical components in FIG. 6 to avoid their description, and only the difference will be explained below.

In FIG. 6, the CPU 10 corresponds to the searching means in one embodiment of the present invention and replacing means. The replacing function of the second embodiment is accomplished by this CPU 10 in one embodiment of the present invention. The details of the replacing function will be given later.

The RAM 12, like the one in the above-described music performance data searching apparatus, is used as storage means for temporarily storing music performance data in one embodiment of the present invention. The music performance data stored in the RAM 12 is the target of the search and replace process (replacing process).

The control panel 15, like the control panel of the music performance data searching apparatus shown in FIG. 1, has a plurality of switches 150 to 154, the dial 16 and the display unit 17. This control panel 15 differs from that of the music performance data searching apparatus in that the replacing switch 151 is newly added. This replacing switch 151 is used to start the replacing process.

The cursor moving switches 153 and 154, like those in the above-described music performance data searching apparatus, are used to move the cursor displayed on the display unit 17. Those cursor moving switches 153 and 154 can also be used to instruct the continuation of the replacing process as well as needed.

The display unit 17, like that of the above-described music performance data, can be used to display a guidance at the time the search data is input and also can be used as a register at the time of inputting the search data. The display unit 17 can also be used to display a guidance at the time of inputting replacement data to be replaced in the replacing process and also can be used as a register at the time of inputting the replacement data.

The keyboard 18 is used to instruct the interval of a musical tone in normal performance mode. The keyboard 18 can be used as the inputting means to enter the search data and/or replacement data in a mode for executing the replacing process (hereinafter called "replace mode"). (The details of the replace mode will be given later.)

The operation of the music performance data replacing apparatus with the above-described structure according to the present invention will now be described in detail referring to the flowchart given in FIGS. 7A and 7B. Only the portion which is directly concerned with the present invention is illustrated in this flowchart.

Figure 7A:
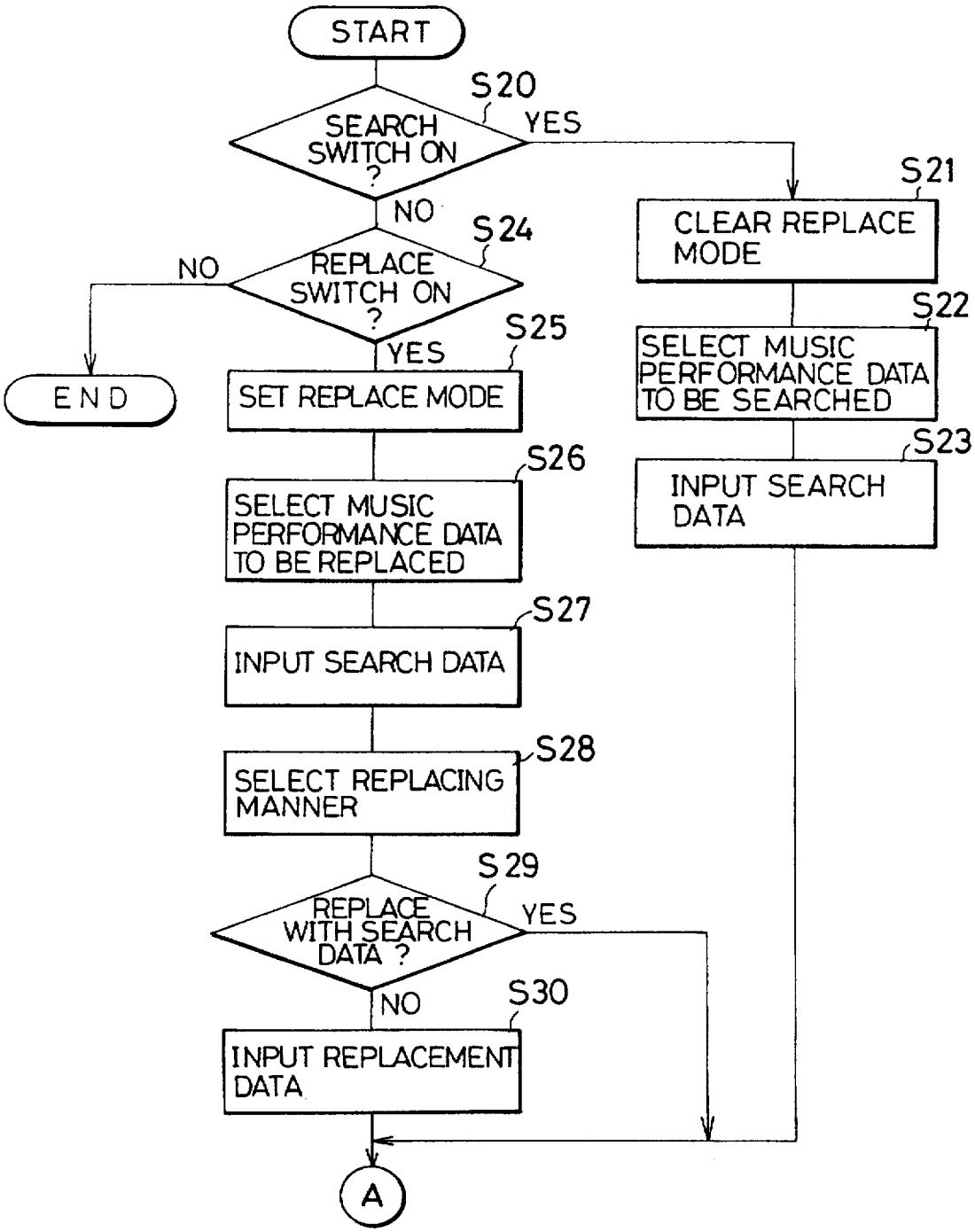
FIGS. 7A and 7B are flowcharts illustrating the operation of the music performance data replacing apparatus according to one embodiment of the present invention.
Figure 7B:
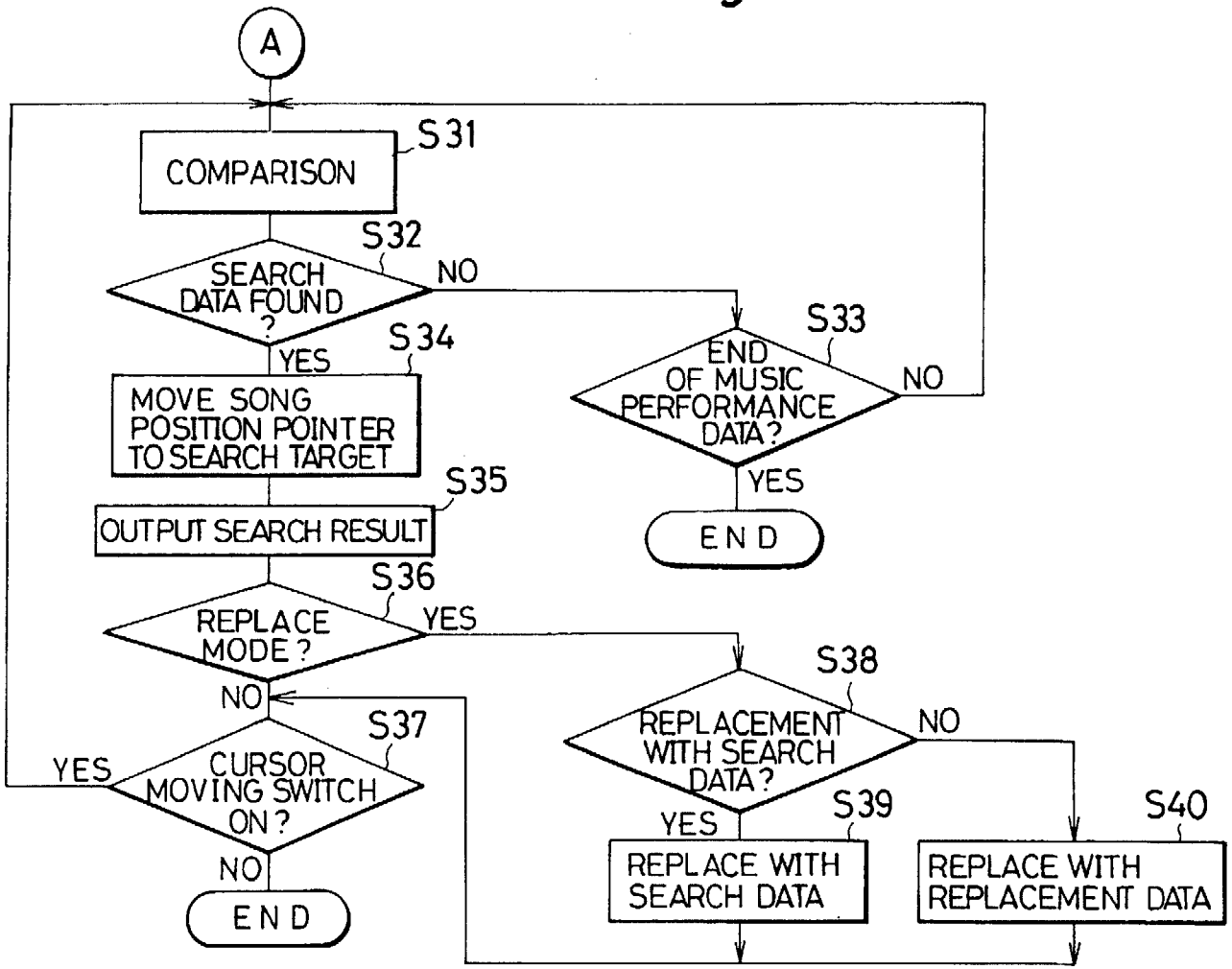

In the flowchart shown in FIGS. 7A and 7B, the searching function and the replacing function are both performed. Of the two functions, the searching function is accomplished by the individual steps in the flowchart shown in FIG. 2 which are incorporated in the flowchart in FIGS. 7A and 7B. The individual steps in the flowchart in FIG. 2 correspond to those in the flowchart shown in FIGS. 7A and 7B as follows.

step S10→step S20 step S11→step S22 step S12→step S23 step S13→step S31 step S14→step S32 step S15→step S33 step S16→step S34 step S17→step S35 step S18→step S37

Whether to execute the search process or the replacing process is determined by whether or not this music performance data replacing apparatus in this embodiment is set in the replace mode. As the manipulation and operation for executing the search process in this music performance data replacing apparatus are the same as those of the above-described music performance data searching apparatus, their description will not be given again. Only the manipulation and operation for executing the replacing process will be described below.

The flowchart shown in FIGS. 7A and 7B illustrates the routine for the replacing process. This routine is called from a main routine (not shown) at every given period.

The replacing process in this music performance data replacing apparatus will be executed in the following manner. First, the song number is selected as needed and then search data is inputted in the same manipulation as done in the above-described search process.

In accordance with the above manipulation, it is checked first in the replacing process whether or not the search switch 150 has been depressed (step S20). This check is conducted in the same way as done in step S10 in FIG. 2. If it is determined that the search switch 150 is off, it is then checked whether or not the replace switch 151 is switched on (step S24). This check is accomplished by checking the panel switch information that indicates the ON or OFF status of the switch which is detected by the panel scan circuit (not shown).

If it is determined that the replace switch 151 is not switched on, the replacing process will be terminated without executing any process. When it is determined that the replace switch 151 is set on, on the other hand, the CPU 10 sets a replace mode flag (not shown) provided in the RAM 12, setting the electronic musical instrument in the replace mode (step S25).

The selection of the music performance data to be replaced will be executed next as needed (step S26). This step will be executed in the same way as the selection of the music performance data to be searched for in step S11 in FIG. 2. In the following replacing process, one piece of the music performance data corresponding to the entered song number is selected. If only one piece of the music performance data is stored in the storage means, this step will be omitted. The selected music performance data or the one piece of the music performance data is the replacement target in the replacing process.

Then, search data is input (step S27). As this process is the same as the process of step S12 in FIG. 2, please refer to the description of the step S12 given earlier. In the subsequent replacing process, the music performance data is searched for a part of the music performance data which corresponds to the search data entered in step S27, and the part of the music performance data becomes the target of the replacement. Various modifications may be applied to this inputting of the search data, as per the above-described music performance data searching apparatus.

Then, the way of replacement will be selected (step S28). More specifically, when the inputting of the search data is completed, the display unit 17 changes its screen to a replacement data selecting screen to allow the player to select the replacing method as shown in FIG. 8, for example. In this state, the player uses the cursor moving switch 153 or 154 and the dial 16 to select the replacement of the searched part of the music performance data with the search data (SC) or the replacement of the searched part of the music performance data with the replacement data (RP). One of the replacing functions may be given to the music performance data replacing apparatus. In this case, steps S28 to S30 will be omitted whenever unnecessary.

More specifically, as the dial 16 is turned rightward, "RP" is displayed and information about the replacement of the searched part of the music performance data with the replacement data is stored in the CPU 10. As the dial 16 is turned leftward, on the other hand, "SC" is displayed and information about the replacement of the searched part of the music performance data with the search data is stored in the CPU 10.

When the player selects "RP" now, the screen shown in FIG. 4 will be displayed on the display unit 17 as in the above-described case of inputting the search data. As in the case of inputting the search data, the player uses the cursor moving switch 153 or 154 and the dial 16 to register the replacement data, and then depresses the input switch 152. When the above operation is completed, the replacing process will start. When the player selects "RP" by manipulating the dial 16 with the replacement data selecting screen displayed on the display unit 17, the replacing process will start immediately.

Then, it is checked if the replacement of the searched part of the music performance data with the search data has been instructed in step S28 (step S29). When it is the replacement with the search data, the flow jumps to step S31. In this case, the inputting of the replacement data is unnecessary so that step S30 will be skipped.

If it is determined in step S29 that the searched part of the music performance data should not be replaced with the search data, the replacement data will be inputted (step S30). The inputting of the replacement data is conducted in the same manner as the inputting of search data in the step S27. Various modifications may be applied to this inputting of the replacement data as in the case of inputting the search data in the above-described music performance data searching apparatus. When the inputting of the replacement data is complete, the flow advances to step S31.

If it is determined in step S20 that the search switch 150 is set on, the electronic musical instrument is set in search mode to perform the search process thereafter (step S21). This mode setting is executed by clearing the replace mode flag (not shown) provided in the RAM 12. Subsequently, the selection of music performance data to be searched for is selected (step S22) as needed, followed by the inputting of the search data (step S23). As the processes of the steps S22 and S23 are the same as those of the steps S26 and S27, their description will not be given again. Various modifications may be applied to this inputting of the search data in step S23 as in the case of inputting the search data in the above-described music performance data searching apparatus. Those steps S21 to S23 have only to be provided as needed in the music performance data replacing apparatus.

When the inputting of the search data and replacement data, if necessary is complete, the flow advances to step S31 after which the search process will start. As the search process in this music performance data replacing apparatus is the same as that in the music performance data searching apparatus, its description will not be repeated and the replacing process (the process in the case where the replace mode flag is set) will be described below.

First, comparison will be performed (step S31). In this comparing process, the music performance data to be replaced is read out piece by piece from the RAM 12 and is compared with the aforementioned search data. In the comparison performed in this replace mode, different comparing systems will be employed in accordance with the replacing method specified in the aforementioned step S28 or depending on the type of the music performance data replacing apparatus.

In replacing the searched part of the music performance data with the replacement data, it is checked if a part of the music performance data which corresponds to the search data is present in the music performance data to be replaced in the same way as done in step S13 in FIG. 2. In this comparing process, a predetermined range (margin) may be given to the search data or a sequence of search music performance data having a predetermined length may be selected as the target of the search.

In replacing the search part of the music performance data with the search data, comparison is conducted so as to check if a sequence of search music performance data includes a predetermined range of the search data. For instance, with a tone name treated as search data, when the tone name "D3" is designated as search data, the comparison is carried out with everything from the tone name "C3" to the tone name "E3" included in the tone name "D3." With regard to the search data including of the velocity values, the beat values or the like, the comparison can be likewise conducted so as to check if a sequence of search music performance data includes a predetermined range of the search data. In this case, the comparing process may be designed in such a way that when at least data specified in the search data is included in the aforementioned music performance data having a predetermined length, the detection of a part of the music performance data which is equivalent to the search data is recognized.

Through the execution of the above comparison, it is checked if the part of the music performance data corresponding to the search data is found, i.e., if the part of the music performance data which satisfies the set searching condition is found (step S32). When it is determined that the search data is not detected in the sequence of search music performance data, it is then checked if there is no more music performance data (step S33). When it is determined that the end of the music performance data has been reached, this replacing process will be terminated.

If it is determined that the comparison has not been conducted until the end of the music performance data, the flow returns to step S31. The position for extracting the music performance data is then advanced, and the next portion of music performance data is extracted as the next sequence of search music performance data to be compared and is subjected to the same process as has been described above. The amount of increment of the extracting position may be changed in accordance with the replacing method. For instance, one piece of data in the music performance data, one bar of data or another predetermined data length may be taken as the amount of the increment.

When it is determined in step S32 in the loop of the steps S31, S32 and S33 that the sequence of search music performance data satisfies the search condition, the song position pointer is shifted to the location of the detected part of the sequence of search music performance data (step S34).

Then, the search result will be outputted as needed (step S35). The search result may be outputted in the same manner as done by the music performance data searching apparatus of the first embodiment.

Then, it can be determined by the player that the replacement with the search data or the replacement data is to be executed, if necessary. It this case, when the dial 16 is turned rightward, the flow goes to step S36. When, the dial 16 is turned leftward, the flow jumps to step S37.

It is then checked if the mode is the replace mode (step S36). As the mode is the replace mode in this case, it is then checked if the replacement with the search data should be performed (step S38). When it is determined that the replacement with the search data is to be executed, the searched part of the music performance data is replaced with the search data (step S39), after which the flow jumps to step S37. When it is determined in step S38 that the replacement with the search data is not to be executed, i.e., that the replacement with the replacement data should be performed, the searched part of the music performance data is replaced with the replacement data (step S40), after which the flow jumps to step S37. If the music performance data replacing apparatus has only one of the replacing functions, that function will automatically be executed.

It is then checked if the cursor moving switch 153 or 154 has been depressed (step S37). When it is determined that the cursor moving switch 153 or 154 has been depressed, the flow returns to step S31 and the above-described operation will be repeated. It is therefore possible to continuously perform the replacing process with respect to the same search data, ensuring easy replacement of the desired music performance data when the same or similar part of the music performance data appears in the music performance data more than once.

At this time, the cursor moving switch 153 is used to instruct the forward search, while the cursor moving switch 154 is used to instruct the backward search. Accordingly, the search is possible in any direction so that the music performance data replacing apparatus has a better operability. If the cursor moving switches 153 and 154 are not given the ability of the instructing means, a single replacing process or a sequence of the replacing process from the beginning to the end of the music performance data would be executed.

With this structure that allows the searched part of the music performance data to be replaced with the search data, it is possible to search and replace not only a part of the music performance data which has the same sequence of tone names, the same sequence of velocity values or the same sequence of beat values, but also a part of the music performance data which has the tone names, velocity values or beat values in a similar sequence.

This method can therefore overcome the otherwise possible drawback such that the entry of the accurate music performance data or accurate search data is not possible in the case of searching the music performance data that is prepared in the real time input or conducting a search using the search data that is entered in the real time input. This method is particularly effective in the case where the music performance data that is prepared in the real time input is to be searched using the velocity values.

As described in details above, the present invention can provide a music performance data replacing apparatus which permits the player to easily search for the position of the music performance data which is to be edited, and to replace it with the desired music performance data by a simple manipulation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electronic musical instrument for performing a piece of music in a normal performance mode and executing a search process in a search mode, comprising:

storage means for storing a plurality of pieces of music performance data, each identified by a corresponding song number;

inputting means for inputting a song number;

selecting means for selecting one of the plurality of pieces of music performance data based on the song number input from said inputting means in the search mode;

a keyboard for instructing an interval of a musical tone in the normal performance mode, and inputting note information to be searched for, the note information including at least one of a sequence of tone names and a sequence of velocity values in the search mode;

automatic searching means for automatically searching the selected one of the plurality of pieces of music performance data for partial music performance data identical to the note information in the search mode;

display means for displaying identifying information of the partial music performance data in the search mode, wherein the identifying information is composed of a bar, beat and step time, the partial music performance data searched for by said automatic searching means being edited in a manual operation; and tone generating means for generating a tone signal based on the interval of the musical tone from the keyboard and the music performance data stored in said storage means in the normal performance mode.

2. The electronic musical instrument according to claim 1, wherein said automatic searching means automatically searches the selected one of the plurality of pieces of music performance data for the partial music performance data having a predetermined relation with the note information in the search mode.

3. The electronic musical instrument according to claim 2, wherein the partial music performance data has the predetermined relation with the note information, which has a predetermined extent.

4. The electronic musical instrument according to claim 2, wherein the partial music performance data has the predetermined relation with the note information and has a predetermined length in which all components of the note information, composed of at least two components, are included in an arbitrary order and in arbitrary positions.

5. The electronic musical instrument according to claim 1 wherein said tone generating means generates a tone signal based on the identifying information of the partial music performance data in the search mode.

6. The electronic musical instrument according to claim 1, further comprising instructing means for instructing continuation of a searching operation.

7. An electronic musical instrument for performing a piece of music in a normal performance mode and executing a replace process in a replace mode, comprising:

storage means for storing a plurality of pieces of music performance data, each identified by a corresponding song number;

inputting means for inputting a song number;

selecting means for selecting one of the plurality of pieces of music performance data based on the song number input from said inputting means in the replace mode;

a keyboard for instructing an interval of a musical tone in the normal performance mode, and inputting note information to be searched for, the note information including at least one of a sequence of tone names and a sequence of velocity values, and for inputting replacement data including at least one of a sequence of tone names and a sequence of velocity values in the replace mode;

automatic searching means for automatically searching the selected one of the plurality of pieces of music performance data for partial music performance data identical to the note information in the replace made;

automatic replacing means for automatically replacing the partial music performance data with the replacement data in the replace mode; and tone generating means for generating a tone signal based on the interval of the musical tone from the keyboard and the music performance data stored in said storage means in the normal performance mode.

8. The electronic musical instrument according to claim 7, wherein said automatic searching means automatically searches the selected one of the plurality of pieces of music performance data for partial music performance data having a predetermined relation with the note information in the replace mode.

9. The electronic musical instrument according to claim 8, wherein the partial music performance data having a predetermined relation with the note information has a predetermined extent.

10. The electronic musical instrument according to claim 8, wherein the partial music performance data has the predetermined relation with the note information and has a predetermined length in which all of components of the note information, composed of at least two components, are included in arbitrary order and in arbitrary position.

11. The electronic musical instrument according to claim 7, further comprising display means for displaying identifying information of the partial music performance data searched for by said automatic searching means in the replace mode, wherein the identifying information is composed of a bar, beat, and step time.

12. The electronic musical instrument according to claim 7, wherein said tone generating means generates a tone signal based on the identifying information of the partial music performance data searched for by said automatic searching means in the replace mode.

13. The electronic musical instrument according to claim 7, further comprising instructing means for instructing continuation of a search and replace operation.

14. An electronic musical instrument for performing a piece of music in a normal performance mode and executing a replace process in a replace mode, comprising:

storage means for storing a plurality of pieces of music performance data, each identified by a corresponding song number;

inputting means for inputting a song number;

selecting means for selecting one of the plurality of pieces of music performance data based on the song number input by said inputting means in the replace mode;

a keyboard for instructing an interval of a musical tone in the normal performance mode, and inputting note information to be searched for in the replace mode, said note information including at least one of a sequence of tone names and a sequence of velocity values;

automatic searching means for automatically searching the selected one of the plurality of pieces of music performance data for partial music performance data having a predetermined relation with the note information in the replace mode;

automatic replacing means for automatically replacing the partial music performance data with the note information in the replace mode search data; and tone generating means for generating a tone signal based on the interval of the musical tone from the keyboard and the music performance data stored in said storage means in the normal performance mode.

15. The electronic musical instrument according to claim 14, wherein the partial music performance data has a predetermined relation with the note information and has a predetermined extent.

16. The electronic musical instrument according to claim 14, wherein the partial music performance data has a predetermined relation with the note information and has a predetermined length, in which all of components of the note information, composed of at least two components, are included in arbitrary order and in arbitrary position.

17. The electronic musical instrument according to claim 14, further comprising display means for displaying identifying information of the partial music performance data searched for by said automatic searching means in the search mode, wherein the identifying information is composed of a bar, beat and step time.

18. The electronic musical instrument according to claim 14, wherein said tone generating means generates a tone signal, based on the identifying information of the partial music performance data searched for by said automatic searching means in the replace mode.

19. The electronic musical instrument according to claim 14, further comprising instructing means for instructing continuation of a search and replace operation.

20. A method of automatically searching for partial music performance data among a plurality of pieces of music performance data having one-to-one correspondence to a plurality of pieces of music, each identified by a corresponding song number, comprising the steps of:

providing a normal performance mode and a search mode;

inputting a song number;

selecting one of the plurality of pieces of music performance data based on the input song number and inputting note information including at least one of a sequence of tone names and a sequence of velocity values to be searched for in the search mode;

automatically searching the selected music performance data for the partial music performance data including the note information in the search mode;

displaying the identifying information of the partial music performance data, wherein the identifying information is composed of a bar, beat and a step time in the search mode;

instructing an interval of a musical tone in the normal performance mode; and generating a tone signal based on the interval of the musical tone and the music performance data in the normal performance mode.

21. A method of automatically searching for partial music performance data according to claim 20, wherein the identifying information is a musical tone.

22. A method of automatically searching and replacing partial music performance data among a plurality of pieces of music performance data having one-to-one correspondence to a plurality of pieces of music, each identified by a corresponding song number, comprising the steps of:

providing a normal performance mode and a replace mode;

inputting a song number;

selecting one of the plurality of pieces of music performance data based on the inputted song number;

inputting note information including at least one of a sequence of tone names and a sequence of velocity values to be searched for and inputting replacement data including at least one of a sequence of tone names and a sequence of velocity values in the replace mode;

automatically searching the selected music performance data for partial music performance data including the note information in the replace mode; and automatically replacing the partial music performance data with the replacement data in the replace mode;

instructing an interval of musical tone in the normal performance mode; and generating a tone signal based on the interval of the musical tone and the music performance data in the normal performance mode.

23. A method of automatically searching and replacing partial music performance data among a plurality of pieces of music performance data having one-to-one correspondence to a plurality of pieces of music, each identified by a corresponding song number, comprising the steps of:

providing a normal performance mode and a replace mode;

selecting one of the plurality of pieces of music performance data based on the inputted song number;

inputting note information including at least one of a sequence of tone names and a sequence to be searched for in the replace mode;

automatically searching the selected pieces of music performance data for the partial music performance data having a predetermined relation with the note information in the replace mode;

instructing a interval of a musical tone in the normal performance mode, automatically replacing the partial music performance data with the note information in the replace mode, and generating a tone signal based on the interval of the musical tone and the music performance data in the normal performance mode.

* * * * *